US010001051B2

(12) United States Patent
Malmgren et al.

(10) Patent No.: US 10,001,051 B2
(45) Date of Patent: Jun. 19, 2018

(54) DEVICE AND METHOD FOR IMPROVING PERFORMANCE OF A MOTOR VEHICLE

(75) Inventors: Björn Malmgren, Hägersten (SE); Hans Wikström, Johanneshov (SE)

(73) Assignee: SCANIA CV AB (SE)

( * ) Notice: Subject to any disclaimer, the term of this patent is extended or adjusted under 35 U.S.C. 154(b) by 1585 days.

(21) Appl. No.: 13/381,482

(22) PCT Filed: Jun. 28, 2010

(86) PCT No.: PCT/SE2010/050732

§ 371 (c)(1),
(2), (4) Date: Dec. 29, 2011

(87) PCT Pub. No.: WO2011/005171

PCT Pub. Date: Jan. 13, 2011

(65) Prior Publication Data

US 2012/0097118 A1 Apr. 26, 2012

(30) Foreign Application Priority Data

Jul. 7, 2009 (SE) ..... 0950536

(51) Int. Cl.
*F01P 7/02* (2006.01)
*F01P 7/08* (2006.01)

(52) U.S. Cl.
CPC ..... *F01P 7/026* (2013.01); *F01P 7/08* (2013.01); *F01P 2023/00* (2013.01)

(58) Field of Classification Search
USPC ..... 123/41.02, 41.12, 41.44
See application file for complete search history.

(56) References Cited

U.S. PATENT DOCUMENTS

| | | | | |
|---|---|---|---|---|
| 4,930,460 | A | 6/1990 | Aihara et al. | |
| 6,044,809 | A | 4/2000 | Till et al. | |
| 6,067,489 | A * | 5/2000 | Letang et al. | 701/36 |
| 2002/0152972 | A1* | 10/2002 | Iwasaki et al. | 123/41.44 |
| 2005/0081801 | A1* | 4/2005 | Braun | F01P 7/048 123/41.1 |
| 2006/0035748 | A1 | 2/2006 | Gabriel et al. | |
| 2006/0102399 | A1* | 5/2006 | Guilfoyle | B60K 11/04 180/68.1 |
| 2007/0006826 | A1 | 1/2007 | Laukemann | |

OTHER PUBLICATIONS

International Search Report dated Oct. 13, 2010, issued in corresponding international application No. PCT/SE2010/050732.

* cited by examiner

*Primary Examiner* — Lindsay Low
*Assistant Examiner* — Ruben Picon-Feliciano
(74) *Attorney, Agent, or Firm* — Ostrolenk Faber LLP

(57) ABSTRACT

A method for improving the performance of a motor vehicle which has a cooler and a fan for cooling the vehicle's engine, the method includes detecting (s410) a temperature-related parameter which affects the engine's temperature during specific cooling conditions; and activating operation of the fan when the engine's temperature fulfils a predetermined condition; determining the (s440) predetermined condition on the basis of outcome as regards engine temperature over a predetermined period of time, and/or outcome as regards the detected parameter over a predetermined period of time. A computer program product includes program code (P) for a computer (200; 210) for implementing a method according to the invention. Also the device that performs the method and a motor vehicle equipped with the device are disclosed.

20 Claims, 4 Drawing Sheets

DEVICE AND METHOD FOR IMPROVING PERFORMANCE OF A MOTOR VEHICLE

CROSS-REFERENCE TO RELATED APPLICATIONS

The present application is a 35 U.S.C. § § 371 national phase conversion of PCT/SE2010/050732, filed Jun. 28, 2010, which claims priority of Swedish Application No. 0950536-3, filed Jul. 7, 2009, the contents of which are incorporated by reference herein. The PCT International Application was published in the English language.

TECHNICAL FIELD

The present invention relates to a method for improving the performance of a motor vehicle. The invention relates also to a computer program product comprising program code for a computer for implementing a method according to the invention. The invention relates also to a device for improving the performance of a motor vehicle, and to a motor vehicle equipped with the device.

BACKGROUND

Today's vehicles are often equipped with an engine fan adapted inter alia to cool the engine. A type of engine fan is connected to and driven by a crankshaft of the engine. Such a fan has a dual function. Its first function is to create a flow of surrounding air which externally cools the engine and components associated with the engine, e.g. electronic components. The second function of the fan is to create an increased air flow through a vehicle cooler by an induction effect or a positive pressure effect, depending on which side of the radiator the fan is situated, thereby improving the cooling of a cooling medium which flows through the vehicle cooler and is intended to cool the engine from inside.

The engine fan is currently controlled electronically by a control unit of the vehicle. The control of the engine fan is currently on the basis of a number of parameters, e.g. the temperature of the cooling medium. As it is driven by the vehicle's engine, it is desirable for the engine fan to be controlled in such a way as to keep fuel consumption as low as possible. If the engine fan is controlled in a way which reduces the amount of fuel needed, there is also a reduction in fan noise, which is advantageous from a work environment perspective for a driver and the surroundings.

However, both the engine and components associated with it will be at a higher average temperature when their cooling is limited in this way. This has undesirable effects in that the service life of the engine and associated components may be shortened. A higher average temperature often contributes to greater wear of such equipment. The cooling system as such may also be subject to more severe wear in conditions which involve higher mean temperatures and more and higher temperature peaks. In situations where the temperature of said cooling medium exceeds a certain temperature, it is also necessary to reduce the engine's power output in order to prevent acutely damaging effects on, for example, the engine, electronic components and the cooling system. This downward adjustment of the engine's power output may be viewed unfavourably by a driver, particularly in situations which normally call for high performance of the vehicle, e.g. when a heavily laden vehicle travels uphill.

In the light of the above, it is currently important to find a compromise for controlling the engine fan in such a way as to achieve a balance between saving fuel on running the fan and increasing the cooling of, for example, the engine and associated electronics in order to reduce their wear.

Static regulation of the fan is current practice, which means that regulating the fan depends on predetermined parameters and limit values of them, and on fan speeds. Limit values for various parameters are adjusted to maintain a balance between fan noise, component wear and fuel consumption. There is therefore a need to improve the performance of today's motor vehicles.

US 20070006826 describes a propulsion system and method for optimisation of energy supply to a cooling system thereof.

SUMMARY OF THE INVENTION

Another object of the invention is to propose a method, a device and a computer program for improving the performance of a motor vehicle.

Another object of the invention is to propose a method, a device and a computer programme for improving the performance of a motor vehicle.

A further object of the invention is to achieve greater versatility for a method, a device and a computer program for improving the performance of a motor vehicle.

These objects are achieved with a method for improving the performance of a motor vehicle of the invention.

An aspect of the invention proposes a method for improving the performance of a motor vehicle which has a cooler and a fan for cooling the vehicle's engine, comprising the steps of:

- detecting a temperature-related parameter which affects the engine's temperature during specific cooling conditions;
- activating operation of the fan when the engine's temperature fulfils a predetermined condition. The method incorporates the step of determining the predetermined condition on the basis of outcome as regards engine temperature over a predetermined period of time, and/or outcome as regards the detected parameter over a predetermined period of time.

With advantage, it is made possible to update said predetermined condition on the basis of data history gathered and stored in a memory of a control unit of the vehicle. The control unit is adapted to assessing whether the predetermined condition needs updating in order to achieve a better compromise between fuel consumption related to running the fan and wear of components of the vehicle, e.g. the engine, associated electronic components and a cooling system of the vehicle. The outcome as regards engine temperature may refer to data pertaining to, for example, the engine's mean temperature. The outcome as regards the detected parameter over a predetermined period of time may incorporate information about mean temperatures of coolant for the engine. An aspect of the invention achieves improved performance of the vehicle in that the setting of the condition is tailored to the unique vehicle for which the invention is implemented. This means that vehicles which usually run in a warm climate will probably have a different setting as regards the predetermined condition than vehicles which usually run in a cold climate. The invention results in a vehicle better adjusted to regional cooling conditions.

The coolant's temperature after warming by the engine may, according to an aspect of the invention, be used as a value for the engine's temperature. The temperature of motor oil in the engine may, according to an aspect of the invention, be used as a value for the engine's temperature.

The temperature of a cylinder block of the engine may, according to an aspect of the invention, be used as a value for the engine's temperature.

Operation of the fan may be activated when the engine's temperature exceeds a first predetermined value, wherein the fan is run when the engine's temperature is within a predetermined range.

According to an example in which the engine's temperature is related to the coolant's temperature, as above described, operation of the fan may be activated when the coolant's temperature exceeds a predetermined value, e.g. 85 degrees Celsius. When the temperature of the coolant, which corresponds to a certain temperature of the engine, is within a range bounded downwards by a first predetermined temperature value and upwards by another, higher, predetermined temperature value, the fan is regulated according to control routines stored in the control unit. If the temperature of the coolant, which corresponds to a certain temperature of the engine, continues to rise during operation and would exceed the upper limit of the range, a downward adjustment of a maximum available power output of the engine is activated to further lower the temperature of the engine.

The fan may be a mechanical fan adapted to being driven by a crankshaft of the engine. It may alternatively be an electric fan driven by a power source, which may for example be batteries adapted to being recharged by the vehicle's engine.

Said predetermined range may be determined on the basis of said outcome as regards engine temperature over a predetermined period of time, and/or outcome as regards the detected parameter over a predetermined period of time. Observation of how the engine temperature varies over a long period of time will make it possible to estimate a more appropriate condition. The condition may for example incorporate and/or take the form of the lower limit of said temperature range. The condition may for example incorporate and/or take the form of the lower limit and the upper limit of said temperature range.

The method may further comprise the step of reducing a maximum available power output of the engine when its temperature exceeds a second predetermined value which is higher than the first predetermined value. Both the first and second predetermined values may therefore be determined on the basis of the outcome as regards engine temperature over a predetermined period of time. Both the first and second predetermined values may also be determined on the basis of the outcome as regards the detected parameter over a predetermined period of time. The result is a vehicle with improved performance in that the flexibility of the control system is enhanced and the activation of both the fan and the controlled reduction of the engine's maximum available power output can be adjusted to current cooling conditions.

Said outcome as regards the engine's temperature may be stored information recorded during operation of the vehicle over a predetermined period of time, e.g. one or two weeks. The period may be chosen as desired. It may be shorter than a week, e.g. an hour or a day. It may be longer than a week, e.g. a month.

The engine's temperature may be detected by an engine temperature sensor. Various temperature sensors may be used to determine a current temperature of the engine during operation. For example, a sensor for detecting the temperature of coolant of the engine may be used to determine the engine's temperature. According to a version, the engine temperature may be defined as the temperature of coolant which has been warmed by the engine. According to a version, the engine's temperature may be calculated by a control unit of the vehicle by means of various models stored therein. According to a version, a sensor for detecting the motor oil's temperature may be used to determine the engine's temperature. According to a version, the engine temperature may be defined as the temperature of the motor oil.

Said outcome as regards the detected parameter may be stored information recorded during operation of the vehicle over a predetermined period of time, e.g. one to two weeks. This period may be chosen as desired. It may be shorter than a week, e.g. an hour or a day. It may be longer than a week, e.g. a month.

The condition may be determined on the basis of outcome as regards the engine's temperature recorded during operation of the vehicle over a predetermined period of time and on the basis of outcome as regards the detected parameter recorded during operation of the vehicle over a predetermined period of time. The predetermined periods of time for outcomes pertaining respectively to the engine's temperature and the detected parameter may be substantially the same. The predetermined periods of time for outcomes pertaining respectively to the engine's temperature and the detected parameter may at least partly overlap.

Said parameter may be chosen from among kinds of parameters, individually or in combination, which are within a category which incorporates coolant temperature, oil temperature of the engine, temperature of surrounding air, charge air temperature and vehicle component temperatures. According to a preferred embodiment, the parameter adopted is coolant temperature.

The parameter adopted can, according to these examples, be detected in a reliable and robust way. Sensors for detecting, for example, coolant temperature, temperature of surrounding air, engine oil temperature and charge air temperature are currently provided in motor vehicles. Thus it is only necessary to install software in a memory of a control unit of the vehicle which is adapted to effecting the innovative method. The above problem is therefore solved in a cost-effective way according to a version of the invention.

Said parameter may be chosen from among kinds of parameter, individually or in combination, which are within a category which incorporates current time of the year, current time of day/night and geographical location. For example, information about times of the year when the vehicle is currently run may serve as a basis for the outcome used for determining the condition. Information about the vehicle's geographical location may likewise serve as a basis for the outcome used for determining the condition.

The method is easy to implement in existing motor vehicles. Software for improving the performance of a motor vehicle according to the invention may be installed in a control unit of the vehicle during the manufacture of the vehicle. A purchaser of the vehicle may thus have the possibility of choosing the method's function as an option. Alternatively, software comprising program code for effecting the innovative method for improving the performance of a motor vehicle may be installed in a control unit of the vehicle on the occasion of updating at a service station, in which case the software may be loaded into a memory in the control unit. Implementing the innovative method is therefore cost-effective, particularly as no further hardware components need be installed in the vehicle. Relevant hardware is currently already provided in the vehicle. The invention therefore represents a cost-effective solution to the problems indicated above.

Software which comprises program code for improving the performance of a motor vehicle is easy to upgrade or replace. Various parts of the software comprising program code for improving the performance of a motor vehicle may also be replaced independently of one another. This modular configuration is advantageous from a maintenance perspective.

The above objects are also achieved with a motor vehicle which comprises features of the device for improving the performance of a motor vehicle. The vehicle may be a truck, a bus or a passenger car. According to another embodiment, the device according to the invention is adapted to being implemented in watercraft, e.g. boats or ships. According to another embodiment, the device according to the invention is adapted to being implemented in a rail vehicle, e.g. a locomotive. According to another embodiment, the device according to the invention is adapted to being implemented in a works vehicle, e.g. a so-called dumper or loader. According to another embodiment, the device according to the invention is adapted to being implemented in an industrial application, e.g. a generating station.

An aspect of the invention proposes a computer program for improving the performance of a motor vehicle, which computer program comprises programme code stored on a computer-readable medium for causing an electronic control unit or another computer connected to the electronic control unit to perform the steps disclosed herein.

An aspect of the invention proposes a computer program product comprising a program code stored on a computer-readable medium for effecting the method steps herein, which computer program is run on an electronic control unit or another computer connected to the electronic control unit.

Further objects, advantages and novel features of the present invention will become apparent to one skilled in the art from the following details, and also by applying the invention. Although the invention is described below, it should be noted that it is not limited to the specific details described. One skilled in the art who has access to the teachings herein will recognise further applications, modifications and incorporations within other fields, which are within the scope of the invention.

BRIEF DESCRIPTION OF THE DRAWINGS

Fuller understanding of the present invention and further objects and advantages of it may be gathered from the following detailed description which is to be read in conjunction with the accompanying drawings, in which the same reference notations pertain to similar parts in the various diagrams, and in which.

DETAILED DESCRIPTION OF THE DRAWINGS

Figure 1:
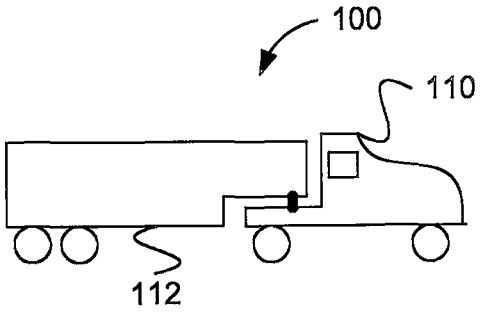
FIG. 1 illustrates schematically a vehicle according to an embodiment of the invention.

FIG. 1 depicts a side view of a vehicle 100. The vehicle 100 exemplified comprises a tractor unit 110 and a trailer 112. The vehicle may be a heavy vehicle, e.g. a truck or a bus. The vehicle may alternatively be a passenger car.

The term "link" refers herein to a communication link which may be a physical line such as an opto-electronic communication line, or a non-physical line such as a wireless connection, e.g. a radio link or microwave link.

The term "line" refers herein to a passage adapted to conveying a fluid, e.g. coolant in a cooling system of the vehicle. The line may be a pipe or a hose.

The line may be made of any desired material, e.g. plastic or rubber. Alternatively it may be made of a metal or alloy, e.g. aluminium or stainless steel.

Figure 2:
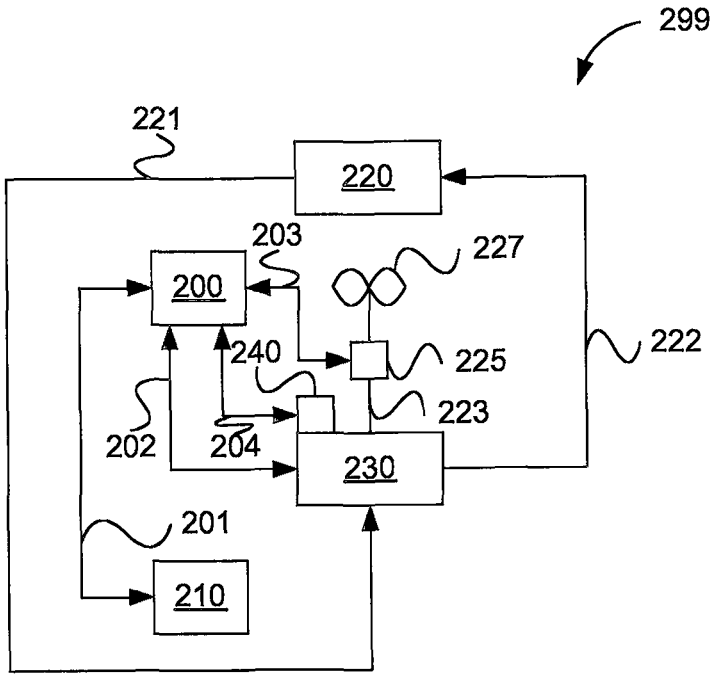
FIG. 2 illustrates schematically a subsystem for the vehicle depicted in FIG. 1, according to an embodiment of the invention.

FIG. 2 depicts a subsystem 299 of the vehicle 100. The subsystem 299 incorporates a cooler 220 which has one or more radiators. At least one radiator is adapted to using air from the surroundings to cool a cooling medium which is in a closed system described below. Said cooling medium may be a coolant, e.g. a mixture of water and glycol. A line 221 is adapted to leading said cooling medium to an engine 230. The engine 230 may be a combustion engine. Said cooling medium is adapted to being led through the engine 230 in order to cool the engine. A line 222 is adapted to leading said cooling medium back to the cooler 220. Said cooling medium is adapted to flowing in a closed cooling system which incorporates the cooler 220, the line 221, the engine 230 and the line 222.

A cooling fan 227 is adapted to being driven by a crankshaft 223 of the engine. A first control unit 200 is adapted to controlling operating means 225 via a link 203. The operating means 225 may be an electromagnetic clutch or, for example, an electromechanical clutch. The first control unit 200 is adapted to controlling the operation of the cooling fan by means of control signals sent to the operating means 225. The operating means 225 is adapted to receiving control signals from the first control unit 200 and to regulating the cooling fan on the basis of them.

According to an alternative embodiment, the cooling fan 227 is an electric fan. The first control unit 200 is adapted to controlling the cooling fan by means of control signals.

The first control unit 200 is adapted to control the engine 230 by means of control signals via a link 202. The first control unit 200 is adapted to controlling a generated power output of the engine 230. The first control unit 200 is also adapted to, when appropriate, adjusting downwards a maximum available output power of the engine 230.

The first control unit 200 is adapted to communicate with a temperature sensor 240 via a link 204. The temperature sensor 240 is situated adjacent to the engine 230. The temperature sensor 240 is adapted to detect a temperature of said cooling medium at the engine and to continuously sending signals containing information about temperatures of said cooling medium to the first control unit 200 via the link 204. The first control unit 200 is adapted to receive said signals from the temperature sensor 240. The value of the detected temperature of said cooling medium may, according to an aspect of the invention, be used as a representation of the engine's temperature.

The first control unit 200 is adapted to use the signals received which contain information about temperatures of said cooling medium as a basis for control of operation of the cooling fan 227 according to an aspect of the invention. The first control unit 200 is adapted to use the signals received containing information about temperatures of said cooling medium as a basis for controlling operation of the engine 230 according to an aspect of the invention.

The first control unit 200 is adapted to use the signals received containing information about temperatures of said cooling medium, which correspond to the engine's temperature, as a basis for assessing whether one or more limit values for activation and control of operation of the cooling fan 227 need updating according to an aspect of the invention. The first control unit 200 is adapted to use the signals received containing information about the temperature of the cooling medium, which corresponds to the engine's temperature, as a basis for assessing whether a limit value for activation of downward adjustment of a maximum available power output of the engine 230 needs updating according to an aspect of the invention.

The first control unit 200 is adapted to use the signals received containing information about temperatures of said cooling medium, which correspond to the engine's temperature, as a basis in appropriate cases for altering a limit value for activation of operation of the cooling fan 227 according to an aspect of the invention. The first control unit 200 is adapted to use the signals received containing information about temperatures of said cooling medium, which correspond to the engine's temperature, as a basis in appropriate cases for altering a limit value for activation of downward adjustment of a maximum available power output of the engine 230 according to an aspect of the invention.

A second control unit 210 is adapted to communicate with the first control unit 200 via a link 201. The second control unit 210 may be detachably connected to the first control unit 200. The second control unit 210 may be a control unit external to the vehicle 100. The second control unit 210 may be adapted to effecting the innovative method steps according to the invention. The second control unit 210 may be used to cross-load software to the first control unit 200, particularly software for effecting the innovative method. The second control unit 210 may alternatively be adapted to communicate with the first control unit 200 via an internal network in the vehicle. The second control unit 210 may for example be adapted to performing substantially similar functions to the first control unit 200, e.g. activating operation of the cooling fan 227 and/or reducing a maximum available output power of the engine 230 on the basis of information comprising the temperature of said cooling medium.

Figure 3:
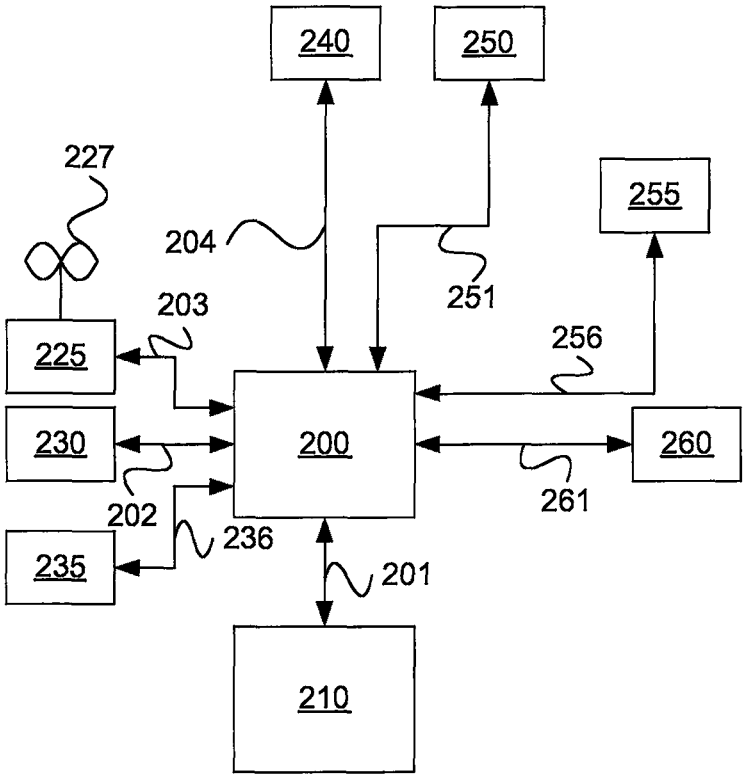
FIG. 3 illustrates schematically a configuration according to an embodiment of the invention.

FIG. 3 depicts schematically a subsystem 399 of the vehicle 100. The subsystem incorporates certain components in common with those described with reference to FIG. 2, e.g. the first control unit 200 and the second control unit 210.

The first control unit 200 is adapted to communicate with the temperature sensor 240 which is itself adapted to continuously detecting the temperature of said cooling medium as described above. The temperature of said cooling medium corresponds, according to an example, to the engine's temperature.

The first control unit 200 is adapted to communicate with an air temperature sensor 250 which is itself adapted to continuously detecting the temperature of air surrounding the vehicle. The air temperature sensor 250 is adapted to detecting the temperature of surrounding air and sending signals containing this information to the first control unit 200 via a link 251. The first control unit 200 is adapted to receiving said signals from the air temperature sensor 250.

In a similar way, the first control unit 200 is adapted to receive signals relevant to the invention from various sensors, instruments, pickups or devices briefly indicated below.

The first control unit 200 is adapted to communicate with a temperature sensor 255 for continuously measuring temperatures of charge air for the vehicle. The sensor 255 is adapted to detecting the temperature of the charge air and sending signals containing this information to the first control unit 200 via a link 256. The first control unit 200 is adapted to receiving said signals from the sensor 255.

The first control unit 200 is adapted to communicate with a device 260 for continuously providing input data to the first control unit 200. The device 260 is a composite term for the various sensors, pickups, measuring devices etc. which may provide parameters relevant to executing the innovative method according to various embodiments of the invention. The device 260 is adapted to sending signals containing this information to the first control unit 200 via a link 261. The first control unit 200 is adapted to receiving said signals from the device 260. The device 260 may for example be a GPS for continuously providing the first control unit with information about the vehicle's geographical location. The device 260 may alternatively be a timer which provides information about current time of the year and/or current time of day/night. The device 260 may be a sensor for measuring temperatures of the engine's motor oil. The device 260 may be a sensor for measuring temperatures of the engine's cylinder block. The device 260 may be a sensor for measuring temperatures of electronic components which are associated with the engine.

Information about the vehicle's location, current time of the year and current time of day/night may be used by the first control unit 200 to determine a predetermined condition on the basis of outcome as regards engine temperature over a predetermined period of time according to an aspect of the invention.

The first control unit 200 is adapted to activate operation of the fan when at least one parameter provided by any of units 240, 250, 255 and/or 260 fulfils a predetermined condition, according to the innovative method. The first control unit 200 is adapted to activate operation of the fan when the engine's temperature provided directly or indirectly by any of units 240, 250, 255 and/or 260 fulfils a predetermined condition, according to the innovative method.

The first control unit 200 is adapted to activate, in appropriate situations, a downward adjustment of a maximum available torque of an output shaft of the engine when at least one parameter provided by any of units 240, 250, 255 and/or 260 exceeds a predetermined value, according to an aspect of the innovative method.

The first control unit 200 is adapted to activate, in appropriate situations, a downward adjustment of a maximum available torque of an output shaft of the engine when the engine's temperature directly or indirectly provided by any of units 240, 250, 255 and/or 260 exceeds a predetermined value, according to an aspect of the innovative method.

The first control unit 200 is adapted to activate, in appropriate situations, a downward adjustment of an electric thermostat 235 of the engine when the engine's temperature provided by any of units 240, 250, 255 and/or 260 exceeds a predetermined value, according to an aspect of the innovative method. The first control unit 200 is adapted to control the thermostat 235 in such a way that said thermostat opens, thereby causing coolant to pass through the cooler 220 and hence be cooled. Alternatively, there is a mechanical thermostat not controlled by the control system.

The first control unit 200 is adapted to use the signals received containing information about temperatures of surrounding air as a basis for controlling operation of the cooling fan 227, according to an aspect of the invention. The first control unit 200 is adapted to use the signals received containing information about temperatures of surrounding air as a basis for controlling the engine 230 according to an aspect of the invention.

The first control unit 200 is adapted to use the signals received containing information about temperatures of surrounding air as a basis for assessing whether limit values for activation of operation of the cooling fan 227 need updating according to an aspect of the invention. The first control unit 200 is adapted to use the signals received containing information about temperatures of surrounding air as a basis for assessing whether limit values for activation of downward adjustment of maximum available power output of the engine 230 need updating according to an aspect of the invention.

The first control unit 200 is adapted to use the signals received containing information about temperatures of surrounding air as a basis in appropriate cases for altering limit values for activation of control of operation of the cooling fan 227 according to an aspect of the invention. The first control unit 200 is adapted to use the signals received containing information about temperatures of surrounding air as a basis in appropriate cases for altering limit values for activation of downward adjustment of maximum available power output of the engine 230 according to an aspect of the invention.

Figure 4A:
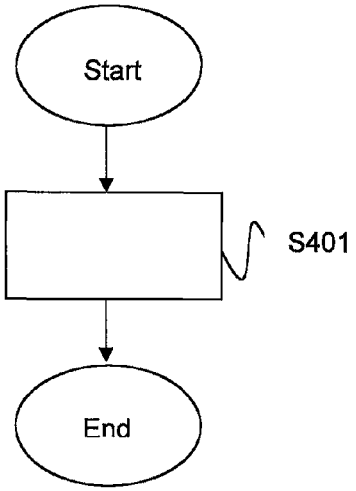
FIG. 4*a* is a schematic flowchart of a method according to an embodiment of the invention.

FIG. 4*a* is a schematic flowchart of a method for improving the performance of a motor vehicle which has a cooler and a fan for cooling the vehicle's engine, according to an embodiment of the invention. The method comprises a first step s401. Step s401 incorporates the step of detecting a temperature-related parameter which affects the engine's temperature during specific cooling conditions. Steps s401 incorporates the step of activating operation of the fan when the engine's temperature fulfils a predetermined condition. Step s401 incorporates the step of determining said predetermined condition on the basis of outcome as regards engine temperature over a predetermined period of time, and/or outcome as regards the detected parameter over a predetermined period of time.

Figure 4B:
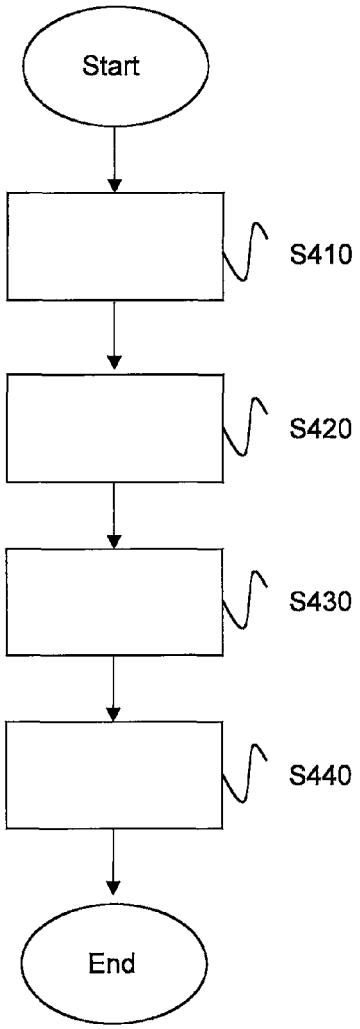
FIG. 4*b* is a schematic flowchart of a method in more detail according to an embodiment of the invention.

FIG. 4*b* is a schematic flowchart of a method for improving the performance of a motor vehicle which has a cooler and fan for cooling the vehicle's engine, according to an embodiment of the invention.

The method comprises a first step s410. Step s410 incorporates the step of detecting the engine's temperature. Step s410 is followed by a step s420.

Method step s420 incorporates the step of comparing a value representing the engine's temperature with a first predetermined value. If the value of the engine's temperature exceeds the first predetermined value, operation of the cooling fan 227 is activated. If the value of the engine's temperature does not exceed the first predetermined value, step s440 below is effected. Step s420 is followed by a step s430.

Method step s430 incorporates the step of comparing the value representing the engine's temperature with a second predetermined value. If the value of the engine's temperature exceeds the second predetermined value, a procedure for reducing the engine's maximum available torque on an output shaft from the engine is activated. If the value of the engine's temperature does not exceed the second predetermined value, only the fan is controlled, since the value of the engine's temperature will still exceed the first predetermined value. Step s430 is followed by a step s440.

Method step s440 incorporates the step of determining the first predetermined value on the basis of outcome as regards engine temperature and/or a parameter detected during a respective predetermined period of time. This is done by analysing data gathered and stored in the control unit as regards the engine's temperature and/or the detected parameter for the respective predetermined period of time. The first predetermined value may be updated in order better to adjust the regulation of the fan to current running conditions.

According to an example, the first predetermined value may be updated to become lower than previously if the outcome shows that a mean value of the engine's temperature during operation over the last two weeks was relatively high and therefore caused undesirable wear of vehicle components.

According to an example, the first predetermined value may be updated to become higher than previously if the outcome shows that a mean value of the engine's temperature during operation over the last three days was relatively low and therefore caused undesirable fuel consumption related to running the engine fan.

Method step s440 incorporates the step of determining the second predetermined value on the basis of outcome as regards engine temperature and/or outcome as regards the parameter detected over a respective predetermined period of time. This is done by analysing data gathered and stored in the control unit as regards engine temperature and/or the detected parameter for the respective predetermined period of time. The second predetermined value may be updated in order better to adjust the reduction in maximum available torque on the engine's output shaft to current running conditions.

According to an example, the second predetermined value may be updated to become lower than previously if the outcome shows that a mean value of the engine's temperature during operation over the last two weeks was relatively high and therefore caused undesirable wear of vehicle components. The method ends after step s440.

Figure 5:
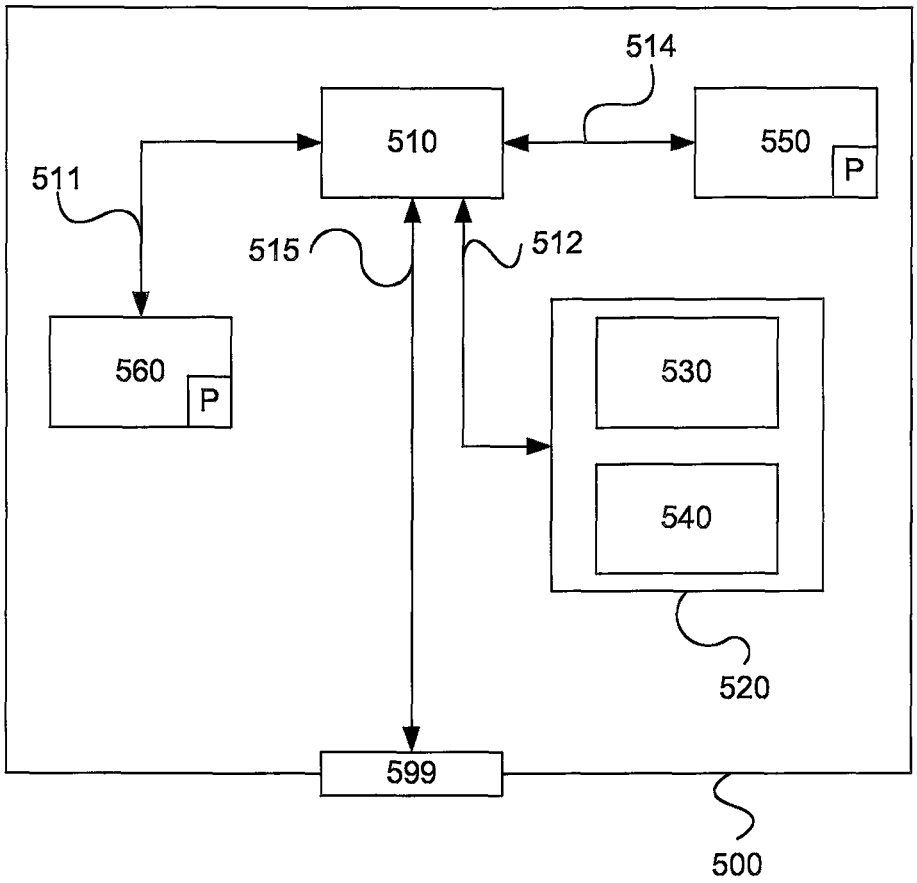
FIG. 5 illustrates schematically a computer according to an embodiment of the invention.

FIG. 5 is a diagram of a version of a device 500. In a version, the control units 200 and 210 described with reference to FIG. 2 may comprise the device 500. The device 500 comprises a non-volatile memory 520, a data processing unit 510 and a read/write memory 550. The non-volatile memory 520 has a first memory element 530 in which a computer program such as an operating system is stored for controlling the function of the device 200. The device 500 further comprises a bus controller, a serial communication port, I/O means, an A/D converter, a time and date input and transfer unit, an event counter and an interruption controller (not depicted). The non-volatile memory 520 has also a second memory element 540.

A computer program P is provided and comprises routines for improving the performance of a motor vehicle which has a cooler and fan for cooling the vehicle's engine, according to the innovative method.

The program P comprises routines for generating an outcome as regards engine temperature over a predetermined period of time on the basis of at least one detected temperature-related parameter which affects the engine's temperature during specific cooling conditions. The program P comprises routines for generating an outcome as regards engine temperature over a predetermined period of time. The program P comprises routines for generating an outcome as regards the detected parameter over a predetermined period of time. The program P comprises routines for activating operation of the fan when the engine's temperature during operation of the vehicle fulfils a predetermined condition, e.g. that the engine's temperature is higher than a predetermined temperature. The engine's temperature may correspond to a temperature of the vehicle's coolant. The engine's temperature may correspond to a temperature of the vehicle's motor oil.

The program P comprises routines for activating operation of the fan when a detected parameter fulfils a predetermined condition, e.g. that detected coolant temperatures exceed a predetermined value. The program P comprises routines for determining said predetermined condition on the basis of outcome as regards engine temperature over a predetermined period of time. The program P may be stored in an executable form or a compressed form in a memory 560 and/or in a read/write memory 550.

Where it is stated that the data processing unit 510 performs a certain function, it means that the data processing unit 510 effects a certain part of the program which is stored in the memory 560 or a certain part of the program which is stored in the read/write memory 550.

The data processing unit 510 can communicate with a data port 599 via a data bus 515. The non-volatile memory 520 is intended for communication with the data processing unit 510 via a data bus 512. The separate memory 560 is intended to communicate with the data processing unit 510 via a data bus 511. The read/write memory 550 is adapted to communicating with the data processing unit 510 via a data bus 514. The data port 599 may have, for example, the links 201, 202, 203, and 204 connected to it (see FIG. 2). The data port 599 may for example have the links 201, 202, 203, 204, 236, 251, 256, and 261 connected to it (see FIG. 3).

When data are received on the data port 599, they are stored temporarily in the second memory element 540. When input data received have been temporarily stored, the data processing unit 510 will be ready to effect code execution in a manner described above. According to a version, signals received on the data port 599 contain information about temperatures of the coolant for cooling the engine. According to a version, signals received on the data port 599 contain information about the temperature of air surrounding the vehicle. According to a version, signals received on the data port 599 contain information about temperatures of charge air for the vehicle. The signals received on the data port 599 may be used by the device 500 to determine a condition relating to activation of operation of the engine fan, according to an aspect of the invention. The signals received on the data port 599 may be used by the device 500 to determine a condition related to control of a maximum available output power of the vehicle's engine, according to an aspect of the invention. The signals received on the data port 599 may be used by the device 500 to determine a limit value for a temperature-related parameter, e.g. temperatures of the coolant or temperatures of surrounding air, which limit value is related to activation of operation of the engine fan, according to an aspect of the invention. The signals received on the data port 599 may be used by the device 500 to determine a limit value for a temperature-related parameter, e.g. temperatures of the coolant or the temperatures of surrounding air, which limit value is related to control of maximum power output of the vehicle's engine, according to an aspect of the invention.

Parts of the methods herein described may be effected by the device 500 by means of the data processing unit 510 which runs the program stored in the memory 560 or the read/write memory 550. When the device 500 runs the program, methods herein described are executed.

The foregoing description of the preferred embodiments of the present invention is provided for illustrative and descriptive purposes. It is not intended to be exhaustive, nor to limit the invention to the variants described. Many modifications and variations will be obvious to one skilled in the art. The embodiments were chosen and described in order best to explain the principles of the invention and their practical applications and hence to make it possible for specialists to understand the invention for various embodiments and with the various modifications appropriate to the intended use.

The invention claimed is:

1. A method for improving the performance of a motor vehicle wherein the vehicle has a cooler and a fan for cooling the vehicle's engine, the method comprising the steps of:

(a) detecting a temperature-related parameter which affects the engine's temperature during specific cooling conditions;

(b) activating operation of the fan when the engine's temperature fulfils a predetermined condition;

(c) determining the predetermined condition on the basis of an outcome in regard to the engine's temperature over a predetermined period of time, and/or an outcome in regard to the detected parameter over a predetermined period of time;

(d) deciding whether the predetermined condition should be altered on the basis of a new outcome in regard to the engine's temperature over the predetermined period of time and/or a new outcome in regard to the detected parameter over the predetermined period of time;

(e) altering the predetermined condition on the basis of the new outcome in regard to the engine's temperature over the predetermined period of time and/or the new outcome in regard to the detected parameter over the predetermined period of time if the decision in step (d) is in the affirmative; and (f) returning to step (d) if the decision in step (d) is in the negative.

2. A method according to claim 1, further comprising the step of:

activating the operation of the fan when the engine's temperature exceeds a first predetermined value, whereby operation of the fan takes place when the engine's temperature is within a predetermined range.

3. A method according to claim 2, wherein the predetermined range of the engine's temperature is determined on the basis of the outcome in regard to the engine's temperature over the predetermined period of time, and/or the outcome in regard to the detected parameter over the predetermined period of time.

4. A method according to claim 2, further comprising the step of:

reducing a maximum available power output of the engine when the engine's temperature exceeds a second predetermined value which is higher than the first predetermined value.

5. A method according to claim 1, wherein the outcome in regard to the engine's temperature is stored information which had been recorded during operation of the vehicle over the predetermined period of time.

6. A method according to claim 1, wherein the outcome in regard to the detected parameter is stored information which had been recorded during operation of the vehicle over the predetermined period of time.

7. A method according to claim 1, wherein the parameter is selected from among kinds of parameter, individually or in combination, which are within a category which includes a coolant temperature, an oil temperature of the engine, a temperature of surrounding air, a charge air temperature and vehicle component temperatures.

8. A method according to claim 1, wherein the parameter is selected from among kinds of parameter, individually or in combination, which are within a category which includes a current time of the year, a current time of day/night and a geographical location.

9. A device for improving the performance of a motor vehicle, wherein the vehicle has a cooler and a fan for cooling the vehicle's engine, the device comprising:

a detector for detecting a temperature-related parameter which affects the engine's temperature during specific cooling conditions;

an activator for activating operation of the fan when the engine's temperature fulfils a predetermined condition; and a control unit for determining the predetermined condition on the basis of an outcome in regard to the engine's temperature over a predetermined period of time, and/or an outcome in regard to the detected parameter over a predetermined period of time, for deciding whether the predetermined condition should be altered on the basis of a new outcome in regard to the engine's temperature over the predetermined period of time and/or a new outcome in regard to the detected parameter over the predetermined period of time, and for altering the predetermined condition on the basis of the new outcome in regard to the engine's temperature over the predetermined period of time and/or the new outcome in regard to the detected parameter over the predetermined period of time.

10. A device according to claim 9, further comprising:

a second activator for activating operation of the fan when the engine's temperature exceeds a first predetermined value, whereby operation of the fan takes place when the engine's temperature is within a predetermined range.

11. A device according to claim 10, wherein the predetermined range of the engine's temperature is determined on the basis of the outcome in regard to the engine's temperature over the predetermined period of time, and/or the outcome in regard to the detected parameter over the predetermined period of time.

12. A device according to claim 10, further comprising:

a device for reducing a maximum available power output of the engine when the engine's temperature exceeds a second predetermined value which is higher than the first predetermined value.

13. A device according to claim 9 wherein the outcome in regard to the engine's temperature is stored information which had been recorded during operation of the vehicle over the predetermined period of time.

14. A device according to claim 9, wherein the outcome in regard to the detected parameter is stored information, which had been recorded during operation of the vehicle over the predetermined period of time.

15. A device according to claim 9, wherein the parameter is selected from among kinds of parameter, individually or in combination, which are within a category which includes a coolant temperature, an oil temperature of the engine, a temperature of surrounding air, a charge air temperature and vehicle component temperatures.

16. A device according to claim 9, wherein the parameter is selected from among kinds of parameter, individually or in combination, comprised within a category which includes a current time of the year, a current time of day/night and a geographical location.

17. A motor vehicle comprising a device according to claim 9.

18. A motor vehicle according to claim 17, wherein the motor vehicle is a truck, a bus or a passenger car.

19. A computer program for improving the performance of a motor vehicle, which computer program comprises program code stored on a non-transitory computer-readable medium for causing an electronic control unit or another computer connected to the electronic control unit to perform the steps according to claim 1.

20. A computer product comprising a computer program stored on a non-transitory computer-readable medium for performing the method steps according to claim 1, the computer program being configured and operable to run on an electronic control unit or another computer connected to the electronic control unit.

* * * * *